US005368290A

United States Patent [19]

Nanba et al.

[11] Patent Number: 5,368,290

[45] Date of Patent: Nov. 29, 1994

[54] PAPER TRANSPORT MECHANISM

[75] Inventors: Hideyuki Nanba, Kawasaki; Koji Hirata, Hyogo; Shigenori Sasaki, Kawasaki, all of Japan

[73] Assignee: Fujitsu Limited, Kawasaki, Japan

[21] Appl. No.: 3,801

[22] Filed: Jan. 13, 1993

[30] Foreign Application Priority Data

Jan. 16, 1992 [JP] Japan ..... 4-005369
May 8, 1992 [JP] Japan ..... 4-116063

[51] Int. Cl.[5] ..... B65H 5/02
[52] U.S. Cl. ..... 271/273
[58] Field of Search ..... 271/272–274, 271/9

[56] References Cited

U.S. PATENT DOCUMENTS 4,948,115 8/1990 Burger ..... 271/273
5,209,133 5/1993 Ballard ..... 271/273 X

FOREIGN PATENT DOCUMENTS 281855 3/1990 Japan ..... 271/273
2249857 10/1990 Japan ..... 271/273
47240 1/1992 Japan ..... 271/273
4-12035 3/1992 Japan .

OTHER PUBLICATIONS

*Patent Abstracts of Japan,* vol. 12, No. 495 (M780) Dec. 23, 1988 (JP 63-212663).

*Primary Examiner*—David H. Bollinger
*Attorney, Agent, or Firm*—Staas & Halsey

[57] ABSTRACT

A paper transport mechanism which is suited for use in an image forming apparatus such as a copying machine which allows the user to more easily remove paper jammed between guide plates. The paper transport mechanism includes at least three guide plates which engage one another when the transport mechanism is in use, but may be separated, each from the other, in order to clear a jammed paper path. The first guide plate has an open and a closed position. The second and third guide plates each have rollers attached. When the paper transport mechanism is in use, the first guide plate is in the closed position and the rollers of the second and third guide plates press against one another and transport paper therebetween. When a paper jam occurs, the first guide plate is moved to the open position and the second and third guide plates and their associated rollers are separated to allow access to any paper jammed therebetween.

16 Claims, 17 Drawing Sheets

FIG.8(A)
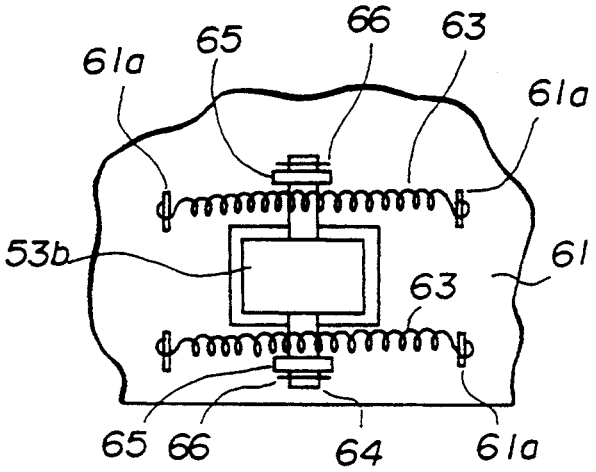
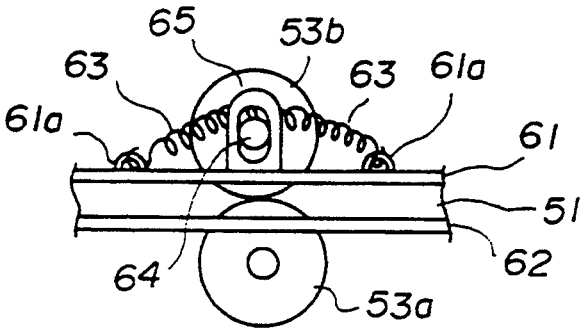
FIG.8(B)

FIG. 11(A)
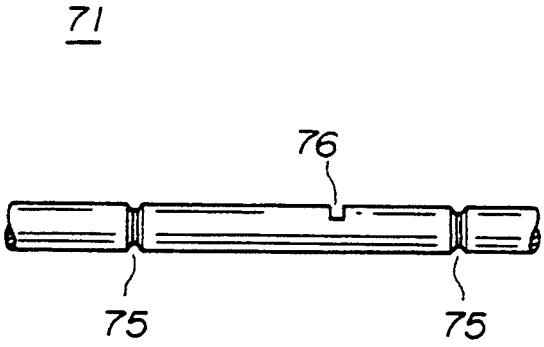
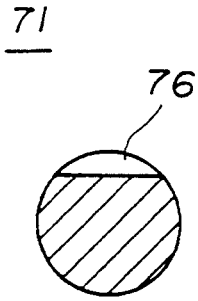
FIG. 11(B)

FIG. 14(A)
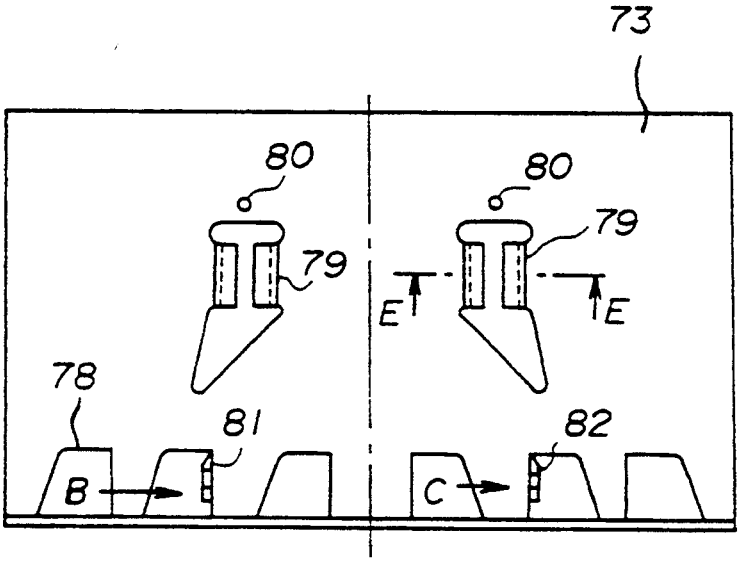
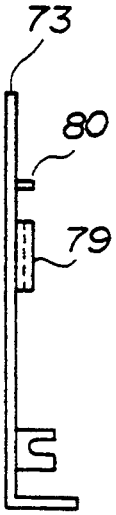
FIG. 14(B)

PAPER TRANSPORT MECHANISM

BACKGROUND OF THE INVENTION

The present invention generally relates to paper transport mechanism, and more particularly to a paper transport mechanism which is suited for use in an image forming apparatus such as a copying machine.

FIG. 1 shows a side view of a conceivable copying machine with a side panel thereof omitted for the sake of convenience. In FIG. 1, a plurality of cassettes 1 are provided in a plurality of stages at predetermined intervals along the vertical direction. Each cassette 1 stores paper 2 which is fed by pickup rollers 3. A transport mechanism 4 transports the paper 2 fed from the pickup rollers 3 to a recording part 5 which records an image on the paper 2. A fixing unit 6 fixes the image which is transferred onto the paper 2 in the recording part. The paper 2 from the fixing unit 6 is ejected onto a tray 7 which stacks the paper 2.

The transport mechanism 4 includes a first guide plate 8 for paper transport, second guide plates 9 for paper transport, and first through third rollers 11, 12 and 13. The second guide plates 9 have the same structure, and confront the first guide plate 8 with a gap formed therebetween. The first rollers 11 are provided on the first and second guide plates 8 and 9 respectively, and the second and third rollers 12 and 13 are respectively provided on each second guide plate 9. The first rollers 11 provided on the first guide plate 8 make pressing contact with the first rollers provided on the second guide plate 9. On the other hand, the second rollers 12 make pressing contact with the corresponding third rollers 13.

The two end parts of each second guide plate 9 are curved towards the cassettes 1. The surface at the end part of one second guide plate 9 confronts the surface of the end part of another second guide plate 9 which is located above or below the one second guide plate 9 with a gap formed therebetween.

If a paper jam occurs in the transport mechanism 4, the first guide plate 8 is opened as shown in FIG. 2 so as to open the transport path. The paper 2 causing the paper jam is the removed from the transport path.

However, the transport path which is formed between two adjacent second guide plates 9 is not opened even when the first guide plate 8 is opened. For this reason, it is difficult to remove a paper 2 jammed between two adjacent second guide plates 9. In some extreme cases, it is impossible to reach for and remove the paper 2 which is stuck between two adjacent second guide plates 9.

If the user cannot reach the paper 2 which is stuck between two adjacent second guide plates 9, the user manually rotates the second roller 12 or the third roller 13 so as to eject the paper 2. However, this manual operation is troublesome for the user to perform. In addition, this manual operation may cause an erroneous operation which may tear the paper 2 which is stuck between the two adjacent second guide plates 9. A torn piece of paper 2 may cause a failure of the copying machine which cannot be repaired by the user, and there are problems in that a service person must attend to the repair and that the copying machine will not be usable for a long time.

These problems of the copying machine also occur in other image forming apparatuses such as printers and facsimile machines which have a paper transport mechanism.

SUMMARY OF THE INVENTION

Accordingly, it is a general object of the present invention to provide a novel and useful paper transport mechanism in which the problems described above are eliminated.

Another and more specific object of the present invention is to provide a paper transport mechanism comprising a first guide plate having an end part, a rotation fulcrum located in a vicinity of the end part, and first rollers, the first guide plate having an open position and a closed position and being normally closed, a second guide plate having a first surface part which confronts the first guide plate with a gap formed therebetween in the closed position of the first guide plate, a second surface part which is curved, and second rollers which make pressing contact with the first rollers in the closed position of the first guide plate so as to transport a paper between the first and second guide plates, a third guide plate having a third surface part which confronts the second surface part of the second guide plate with a gap formed therebetween, and third rollers which make pressing contact with the second rollers in the closed position of the first guide plate so as to transport a paper between the second and third guide plates, and means, coupled to the first and third guide plates, for urging the third rollers against the second rollers in the closed position of the first guide plate and for separating the third rollers from the second rollers in the open position of the first guide plate. According to the paper transport mechanism of the present invention, it is possible to open all of the transport paths of the paper transport mechanism when a paper jam occurs. For this reason, it is possible to easily and accurately remove the paper which causes the paper jam.

Still another object of the present invention is to provide a roller support structure for supporting first rollers which are to make pressing contact with second rollers, comprising a plurality of first rollers respectively having resilient engaging parts, a shaft having a peripheral surface, a plurality of first grooves and at least one second groove which are provided on the peripheral surface, each of the first grooves having a ring shape and being engaged by the resilient engaging parts of the first rollers, the second groove having a semi-circular shape, a guide member, a pair of bearings, provided on the guide member, for supporting the shaft including an engaging part for engaging the second groove so as to restrict the shaft in circumferential and axial directions thereof, and spring means, provided on the guide member, for urging the shaft in a direction so that the first rollers make pressing contact with corresponding second rollers. According to the roller support structure of the present invention, it is possible to realize an inexpensive roller support structure which has a small number of parts and is easy to assemble.

Other objects and further features of the present invention will be apparent from the following detailed description when read in conjunction with the accompanying drawings.

BRIEF DESCRIPTION OF THE DRAWINGS

FIG. 8, comprising subparts (A) and (B), is a diagram for illustrating a sub roller support structure;

FIG. 11, comprising subparts (A) and (B), is a diagram showing the construction of a shaft of the embodiment shown in FIG. 10;

FIG. 14, comprising subparts (A) and (B), is a diagram for illustrating the construction of a guide member of the embodiment shown in FIG. 10;

DESCRIPTION OF THE PREFERRED EMBODIMENTS

Figure 3:
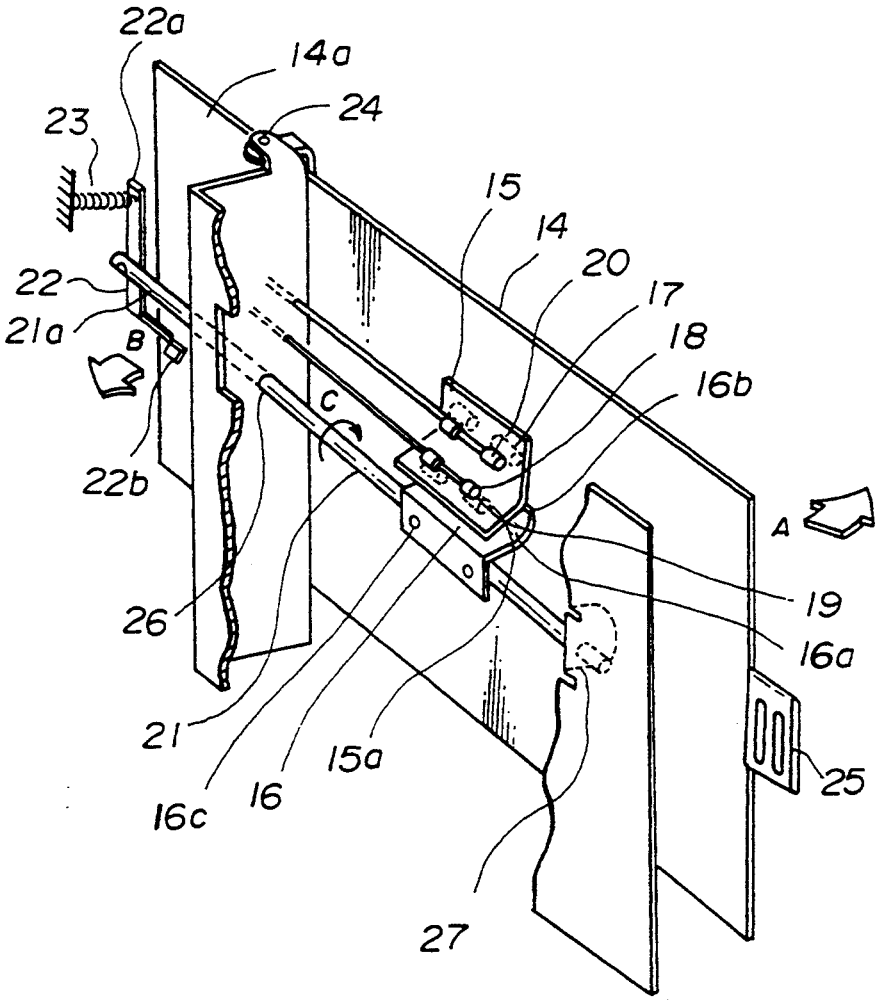
FIG. 3 is a perspective view showing an essential part of a first embodiment of a paper transport mechanism according to the present invention.

First, a description will be given of a first embodiment of a paper transport mechanism according to the present invention, by referring to FIGS. 3 through 5. FIG. 3 shows a perspective view of an essential part of the first embodiment, FIG. 4 shows a side view of an essential part of the first embodiment, and FIG. 5 shows a side view of an essential part of the first embodiment in a state where the paper transport mechanism is opened.

Figure 1:
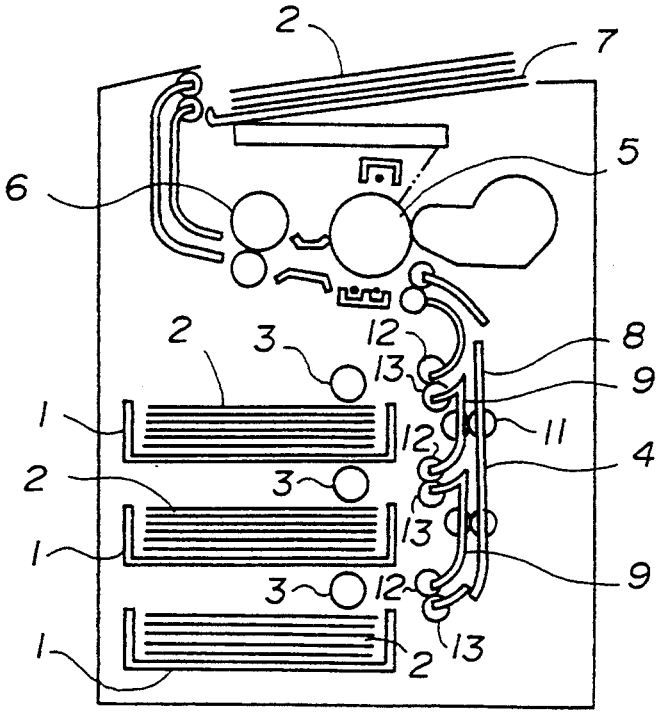
FIG. 1 is a side view showing a conceivable copying machine with a side panel omitted.
Figure 2:
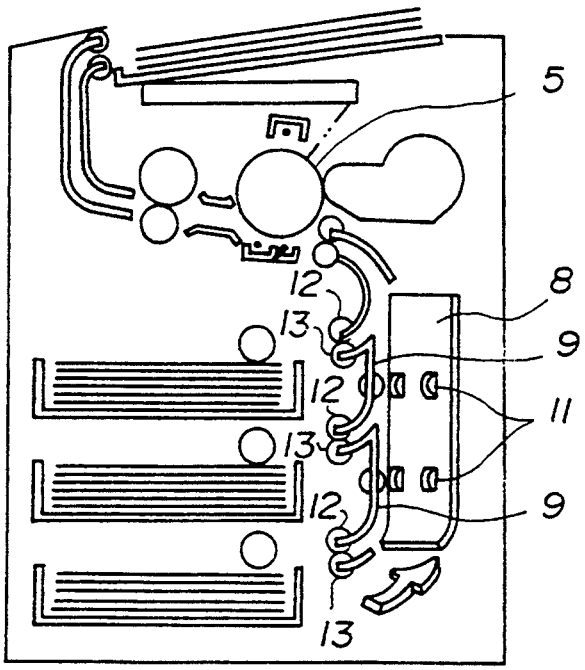
FIG. 2 is a side view showing the copying machine shown in FIG. 1 in a state where a first guide plate is opened.

For example, this embodiment is applied to the copying machine shown in FIGS. 1 and 2.

Figure 4:
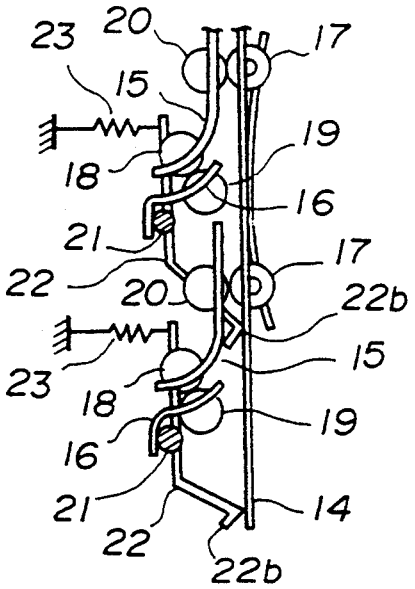
FIG. 4 is a side view showing an essential part of the first embodiment.
Figure 5:
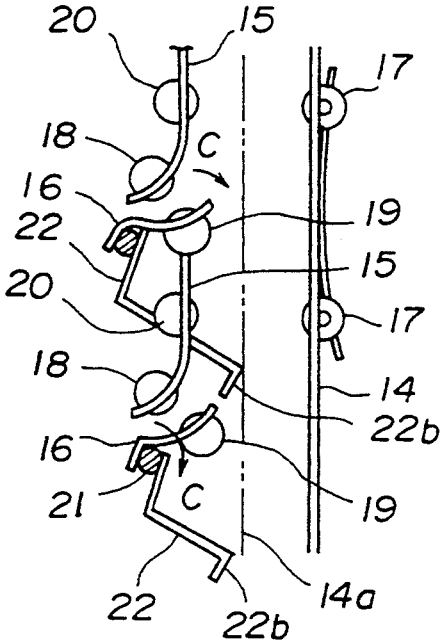
FIG. 5 is a side view showing an essential part of the first embodiment in a state where the paper transport mechanism is opened.

As shown in FIGS. 3 and 4, a first guide plate 14 for paper transport includes a rotation fulcrum 24 in a vicinity of an end part 14*a*. A second guide plate 15 confronts the first guide plate 14 with a gap formed therebetween, and has a surface part 15*a*. A third guide plate 16 for paper transport has a surface part 16*a*, a tip end part 16*b*, and a rear end part 16*c*. The surface part 16*a* confronts the surface part 15*a* which is bent outwardly at the lower part of the second guide plate 15, and a gap is formed between the surface parts 16*a* and 15*a*. The tip end part 16*b* confronts the first guide plate 14 with a gap formed therebetween.

A shaft 21 supports the rear end part 16*c* of the third guide plate 16, and is rotatably supported by bearings 26 and 27. Hence, the third guide plate 16 is pivottable about the shaft 21, and third rollers 19 provided on the third guide plate 16 push against second rollers 18 which are provided on the second guide plate 15. A lever 22 is provided on an end part 21*a* of the shaft 21. This lever 22 has an end part 22*a* and a contact end part 22*b*. The end part 22*a* of the lever 22 connects to an extension spring 23 which urges the shaft 21 to rotate. The contact end part 22*b* of the lever 22 can make contact with the end part 14*a* of the first guide plate 14 at a position on the outer side relative to the rotation fulcrum 24.

In the closed state of the first guide plate 14, the first rollers 17 of the first guide plate 14 make pressing contact with fourth rollers 20 of the second guide plate 15. In this state, the end part 14*a* of the first guide plate 14 does not push against the contact end part 22*b* of the lever 22, and the second rollers 18 and the third rollers 19 are in pressing contact as shown in FIG. 4.

On the other hand, when the first guide plate 14 is opened in a direction A in FIG. 3 by pulling a handle 25, the first rollers 17 of the first guide plate 14 separate from the fourth rollers 20 of the second guide plate 15. In this state, the end part 14*a* of the first guide plate 14 rotates in a direction B in FIG. 3 and pushes against the contact end part 22*b* of the lever 22. In addition, the third guide plate 16 is pivotted in a direction C via the shaft 21 so as to separate from the second guide plate 15 as shown in FIG. 5. As a result, the second rollers 18 separate from the third rollers 19.

Therefore, by opening the first guide plate 14, it is possible to open both the transport path between the first and second guide plates 14 and 15 and the transport path between the second and third guide plates 15 and 16. Hence, it becomes possible to easily remove the paper which is stuck in either of the two transport paths.

Next, a description will be given of main and sub rollers. In the image forming apparatus, the paper is transported to a predetermined position by a main roller and a sub roller which makes pressing contact with the main roller and rotates therewith. The sub roller makes pressing contact with the main roller in a manner such that the sub roller can recede with respect to the main roller.

Figure 6:
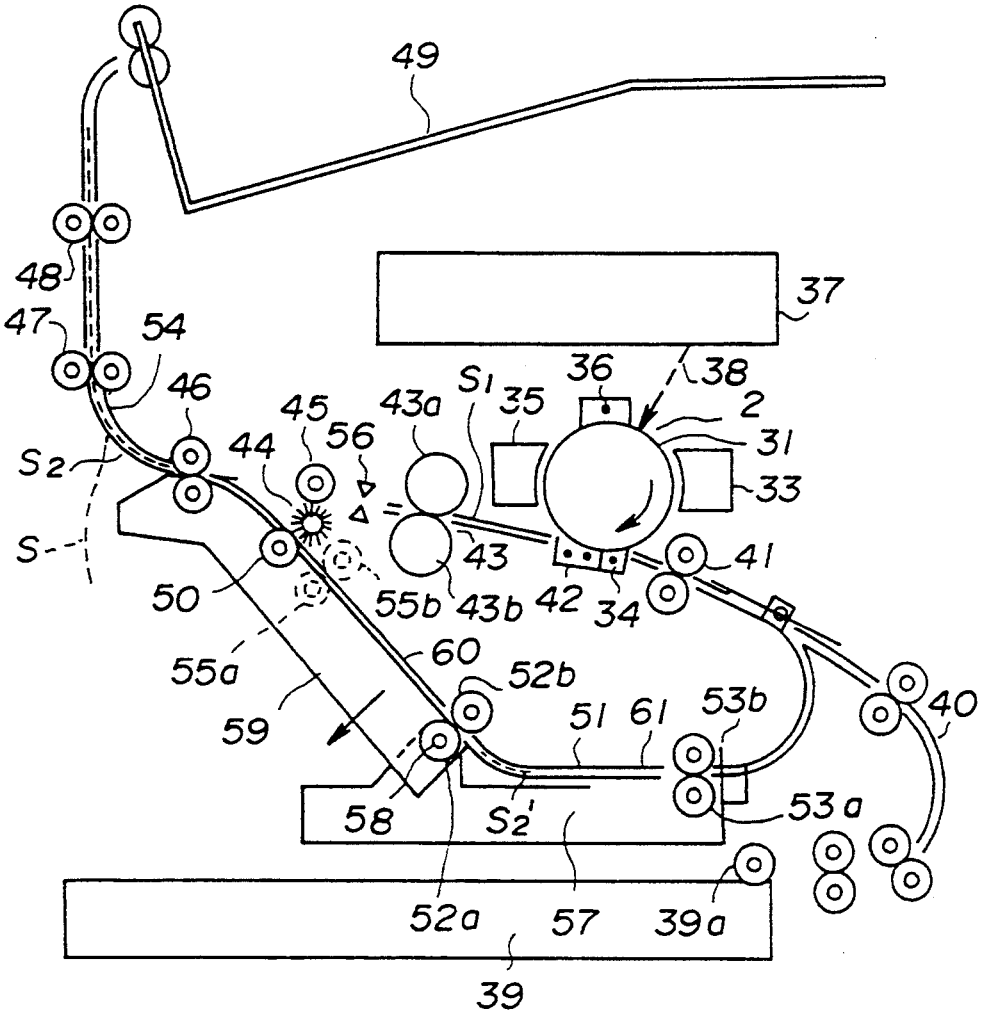
FIG. 6 is a side view showing a general construction of a duplex printer.

FIG. 6 shows an essential part of a duplex printer which transports the paper to a predetermined position by the rotations of the main and sub rollers, In FIG. 6, the duplex printer includes a photosensitive or photoconductive drum 31, a paper cassette 39, a paper supply part 40, alignment or positioning rollers 41, a fixing unit 43, a transport path 51 for back side printing, and a transport path 54 for ejection.

An exposure part 32, a developing unit 33, a transfer unit 34 provided with a separation charger 42, a cleaning unit 35 and a uniform charger 36 are arranged on the periphery of the photosensitive drum 31. An optical system unit 37 is arranged above the photosensitive drum 31. The fixing unit 43 includes a heat roller 43*a* and a pressing roller 43*b* which presses against the heat roller 43a. The heat roller 43a has a built-in heat source (not shown).

A base 57, a frame 59 which is supported on the base 57 via a support shaft 58, a guide member 60 which is supported on the frame 59 in a manner free to open and close, and a guide member 61 which is supported on the base 57 in a manner free to open and close, are respectively arranged along the transport path 51. Confronting rollers 50, driving side transport rollers 55a, 52a and 53a are provided on the side of the frame 59 and the base 57. On the other hand, sub rollers 55b, 52b and 53b are provided on the side of the guide members 60 and 61. The frame 59 is normally positioned to the inclined state shown in FIG. 6. In addition, the guide members 60 and 61 are normally closed to the positions shown in FIG. 6. The paper passes between the closed guide members 60 and 61, and the frame 59 and the base 57, and is transported by the transport rollers 55a, 52a and 53a and the sub rollers 55b, 52b and 53b which press against the transport rollers 55a, 52a and 53a.

At the time of the printing, the photosensitive drum 31 is rotated clockwise as indicated by an arrow in FIG. 6. After the surface of the photosensitive drum 31 is uniformly charged by the uniform charger 36, the charged surface is exposed by irradiating information light 38 from the optical system unit 37 to the exposure part 32. As a result, an electrostatic image is formed on the surface of the photosensitive drum 31. This electrostatic image is developed by the developing unit 33 and formed into a toner image.

On the other hand, the paper which is accommodated in the paper cassette 39 is fed out by pickup rollers 39a and is transported to the alignment rollers 41 via the paper supply part 40. In this state, the tip end of the paper is aligned, and is then supplied to a transfer position between the photosensitive drum 31 and the transfer unit 34 in synchronism with the timing of the toner image. At the transfer position, the toner image on the photosensitive drum 31 is transferred onto the paper by the transfer unit 34, and the paper is thereafter separated from the photosensitive drum 31 by the separation charger 42.

The paper which separates from the photosensitive drum 31 enters between the rollers of the fixing unit 43, and the toner image is fixed by the heating provided by the heat roller 43a and the pressure applied by the pressing roller 43b. Thereafter, the paper is transported by an impeller 44 and the confronting roller 45. In the case of a one-sided printing, the paper is transported upwardly by rollers 46, 47 and 48 which rotate in the forward direction and is ejected onto an eject tray 49.

On the other hand, in the case of a two-sided printing, the paper which passes between the impeller 44 and the confronting rollers 45 is first transported upwardly by the rollers 46, 47 and 48 which rotate in the forward direction, and is then transported downwardly by the rollers 46, 47 and 48 which rotate in the reverse direction after a predetermined time elapses from a time when the rear end of the paper is detected by a sensor 56. Hence the paper is transported within the transport path 51 by the transport rollers 55a, 52a and 53a and the sub rollers 55b, 52b and 53b which press against the transport rollers 55a, 52a and 53a. A plurality of pairs of the transport roller and the sub roller which make pressing contact with this transport roller are arranged in a direction perpendicular to the drawing (paper) surface in FIG. 6.

The paper which passes between the rollers in the transport path 51 is again supplied to the alignment rollers 41 in a state where the front and back sides thereof are reversed. During this time, the toner image to be formed on the back side of the paper is formed on the surface of the photosensitive drum 31. Thereafter, the toner image is transferred onto the paper and fixed by a procedure similar to that described above for the printing on the front side of the paper. Thereafter, the paper is ejected onto the eject tray 49 by the rollers 46, 47 and 48 which rotate in the forward direction.

In this case, if the printing on the back side of a first sheet S1 is being made and a second sheet S2 having the printing made on only one side thereof is transported in front of the first sheet S1, the second sheet S2 interferes with the first sheet S1 from being ejected onto the eject tray 49 after the printing on the back side of the first sheet S1 ends. In other words, when the toner image is transferred by the transfer unit 34 and the fixing is made by the fixing unit 43, the first sheet S1 is transported towards the eject tray 49, but the second sheet S2 which is in front of this first sheet S1 is first transported in the eject direction until the rear end of the second sheet S2 passes the impeller 44 but is thereafter transported towards the transport path 51 by the rollers 46, 47 and 48 which rotate in the reverse direction.

Figure 7:
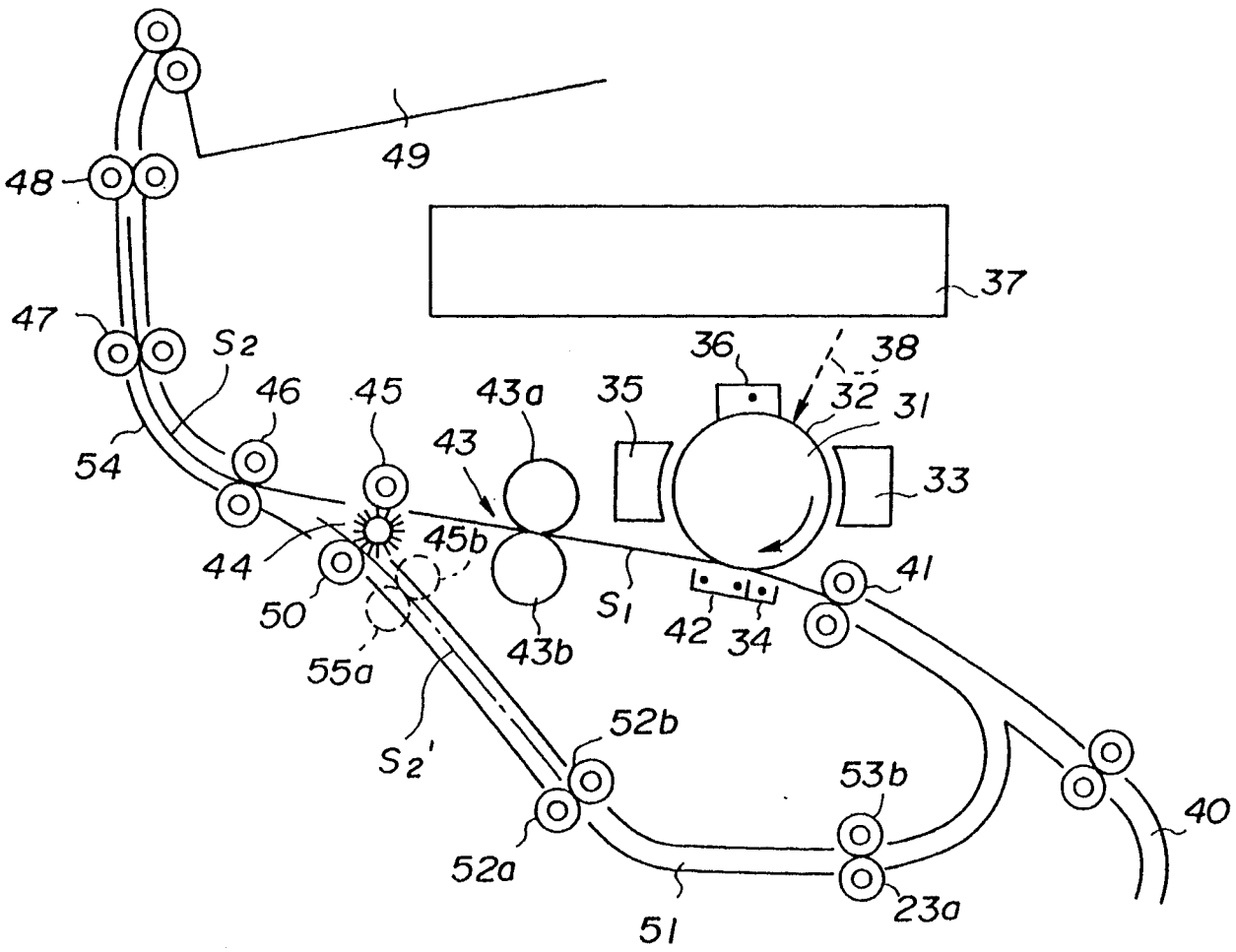
FIG. 7 is a diagram for illustrating a sheet transport in the duplex printer shown in FIG. 6.

Accordingly, the first sheet S1 which is printed on both sides thereof cannot be transported in the transport path 54 towards the eject tray 49 until the second sheet S2 which is transported in front of the first sheet S1 recedes completely into the transport path 51. For this reason, in actual practice, the second sheet S2 and the first sheet S1 are transported with an interval so that the tip end of the first sheet S1 which is printed on both sides thereof becomes pinched between the impeller 44 and the confronting rollers 45 after the second sheet S2 which is printed on only the front side thereof completely recedes into the transport path 51 as indicated by a one-dot chain line S2 in FIG. 7. In other words, if the second sheet S2 which is printed on only one side thereof is located at the position indicated by the solid line in FIG. 7, the first sheet S1 which is to be printed on the back side thereof is being transported in the transport path 51 which trails the second sheet S2 by at least the length of the sheet.

Therefore, the printing speed cannot be improved, and the first sheet S1 which is printed on both sides thereof is ejected with a time delay. In addition, if the first sheet S1 which is printed on both sides thereof is transported within the printer without being ejected quickly, the number of sheets being transported within the printer at one time becomes large, thereby increasing the possibility of a paper jam occurring. Furthermore, if a large number of sheets exist within the printer when the printer is stopped to remove the paper jam, the operation of removing the sheet which is causing the paper jam becomes troublesome to perform and also difficult to perform.

In order to eliminate the above described problem, it is effective to transport the second sheet S2 into the transport path 51 so as to recede at a transport speed which is higher than the transport speed of the second sheet S1 in the ejecting direction. More particularly, the rotational speed of the rollers 46, 47 and 48 in the reverse direction is made higher than that in the forward direction. By taking this measure, it is possible to shorten the intervals of the sheets within the printer and improve the printing speed. In addition, since the number of sheets being transported within the printer at one time is reduced, the possibility of the paper jam occurring is reduced and the operation of removing the paper jam is facilitated.

Next, a description will be given of the support structure of each sub roller which is arranged along the transport path 51 and makes pressing contact with the corresponding one of the transport rollers 55*a*, 52*a* and 53*a*. For the sake of convenience, a description will be given of the sub roller 53*b* with reference to FIGS. 8 and 9.

FIG. 8 shows the support structure of the sub roller 53*b*. In FIG. 8, (A) shows a plan view and (B) shows a side view. In FIG. 8, a guide member 62 confronts a guide member 61 and forms the transport path 51. A shaft 64 of the sub roller 53*b* is supported by bearings 65 which are provided on the guide member 61, so that the shaft 64 can move up and down. The shaft 64 is held in the axial direction by stoppers 66. One pushing spring 63 is provided across each pair of engaging pieces 61*a* provided on the guide member 61. The shaft 64 is pushed by the pushing springs 63, so that the sub roller 53*b* is urged to make pressing contact with the corresponding transport roller 53*a*.

Figure 9:
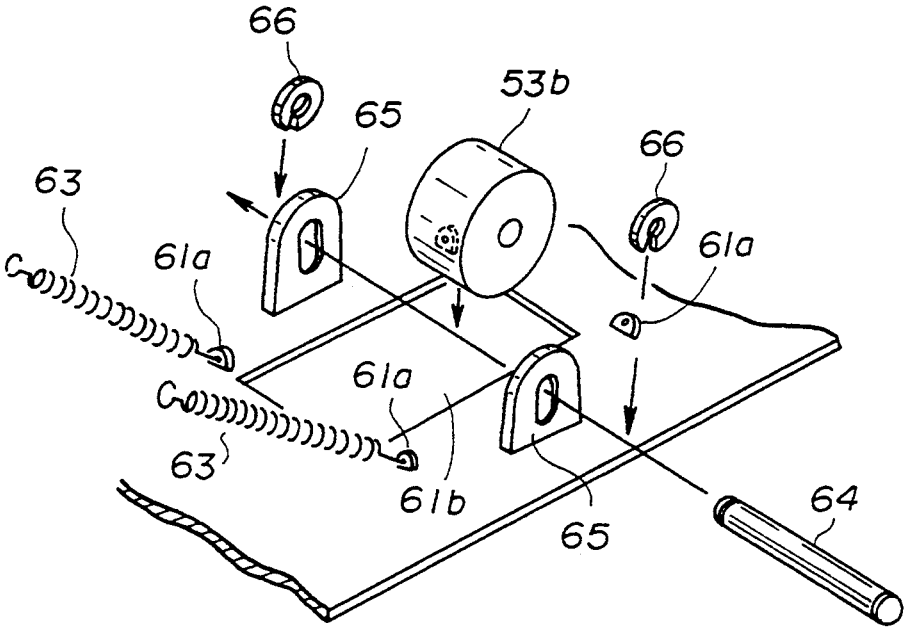
FIG. 9 is a diagram for illustrating a process of mounting the sub roller support structure shown in FIG. 8.

When mounting the sub roller 53*b*, the sub roller 53*b* is fit into a hole 61*b* of the guide member 61 as sown in FIG. 9, and the shaft 64 inserted through a hole in the sub roller 53*b*. This shaft 64 is inserted into the bearings 65 and is stopped in the axial direction by the stoppers 66. Finally, the pushing spring 63 which has one end engaged to the engaging piece 61*a* is fit over the shaft 64 by engaging the other end of the pushing spring 63 to the other engaging piece 61*a*. The other pushing spring 63 is fit in a similar manner.

However, the number of pairs of the transport roller and the sub roller is more than one, and a plurality of pairs are arranged in the axial direction, that is, in a direction perpendicular to the drawing (paper) surface in FIG. 6. For this reason, the above described operation of mounting the sub roller must be performed for each pair, and an extremely troublesome operation is necessary particularly because of the large number of parts involved.

Next, a description will be given of an embodiment of a sub roller support structure which can eliminate this problem, by referring to FIGS. 10 through 19. This sub roller support structure is particularly suited for use in combination with the paper transport mechanism according to the present invention.

Figure 10:
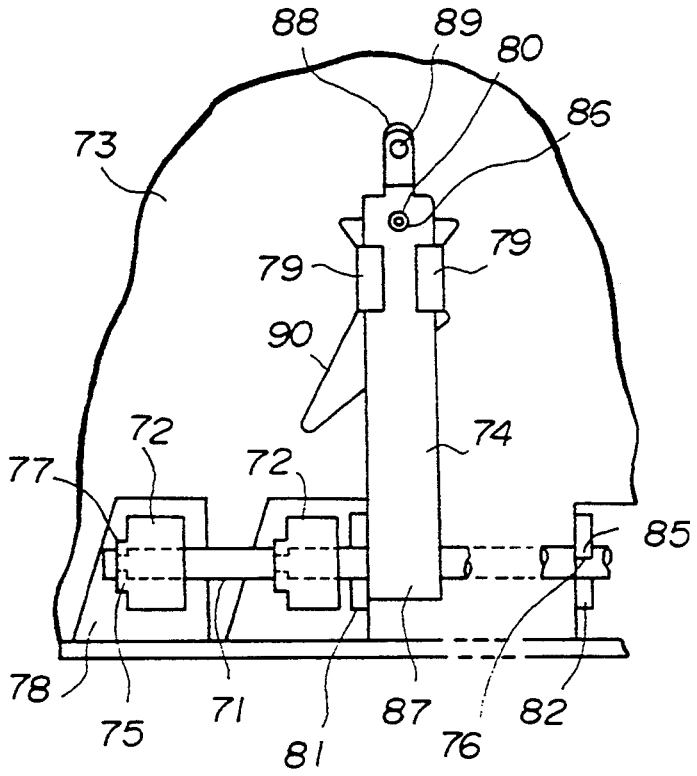
FIG. 10 is a plan view showing an embodiment of a sub roller support structure according to the present invention.

FIG. 10 is a plan view showing the sub roller support structure including a shaft 71, a sub roller 72 made of a resin, a guide member 73, and an urging means 74. The guide member 73 corresponds to the guide member 61 described above.

As shown in the side view of FIG. 11 (A), the shaft 71 includes a plurality of ring-shaped first grooves 75 and a plurality of second grooves 76. As shown in FIG. 11 (B) which shows a cross section of the shaft 71, the second groove 76 has a semi-circular shape.

Figure 12A:
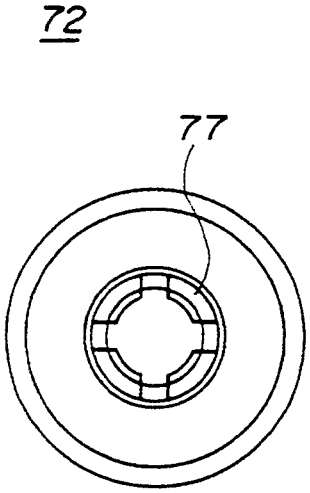
FIG. 12, comprising subparts (A) and (B), is a diagram for illustrating the construction of a sub roller of the embodiment shown in FIG. 10.
Figure 12B:
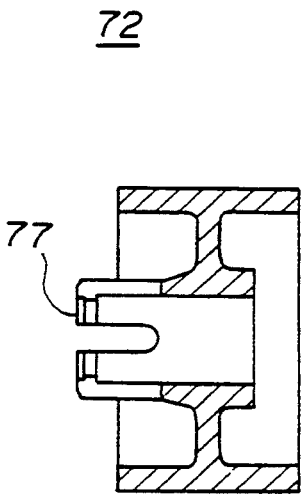
Figure 13A:
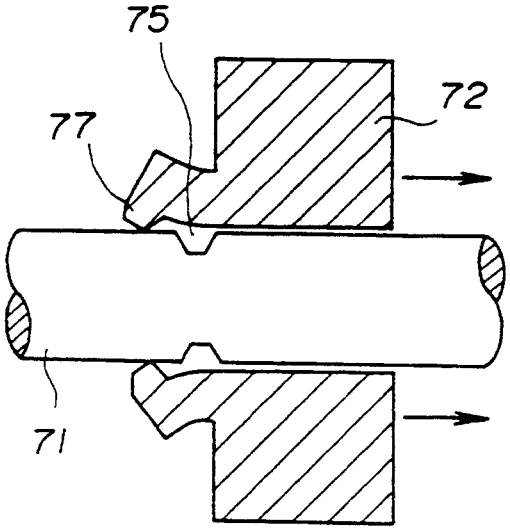
FIG. 13, comprising subparts (A) and (B), is a diagram for explaining the process of mounting the sub roller support structure shown in FIG. 10.
Figure 13B:
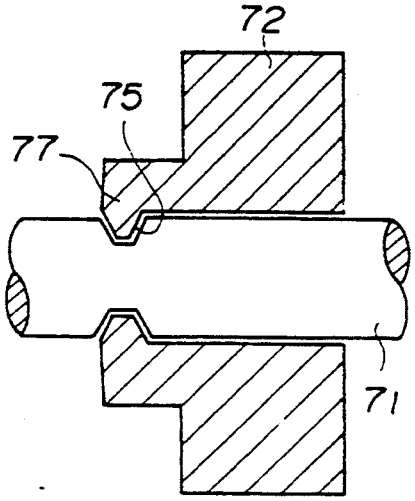

FIG. 12 shows the sub roller 72 in more detail. In FIG. 12, (A) shows a front view of the sub roller 72, and (B) shows a side view of the sub roller 72. As shown in FIG. 12, the sub roller 72 includes resilient claw shaped engaging parts 77 which are arranged at constant intervals along the circumferential direction. The sub roller 72 is fit on the shaft 71. When fitting the sub roller 72 on the shaft 71, the sub roller 72 is pushed in the direction of arrows in FIG. 13 (A) using the resiliency of the engaging parts 77, until the engaging parts 77 engage the first groove 75 as shown in FIG. 13 (B). In the state shown in FIG. 13 (B), a gap on the order of 0.1 to 0.2 mm exists between each engaging part 77 and the surfaces defining the first groove 75, and the sub roller 72 is rotatable in a state where the sub roller 72 is fixed in the axial direction of the shaft 71.

FIG. 14 shows the guide member 73 in more detail. In FIG. 14, (A) shows a side view of the guide member 73, and (B) shows a plan view of the guide member 73. As shown in FIG. 14, the guide member 73 is provided with a plurality of cutouts 78, a pair of holding parts 79, and pins (positioning parts) 80. The outer peripheral parts of a plurality of sub rollers 72 which are provided on the shaft 71 fit into the cutouts 78. The pair of holding parts 79 holds a pair of urging means 74 in a detachable manner. The pins 50 are provided near the respective holding parts 79 and are used to position the urging means 74.

Figure 15A:
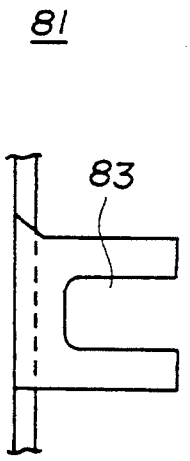
FIG. 15, comprising subparts (A) and (B), is a diagram for illustrating the construction of bearings of the embodiment shown in FIG. 10.
Figure 15B:
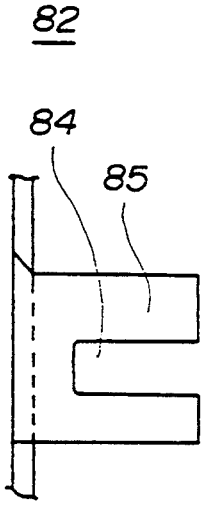

Bearings 81 and 82 are provided in two selected cutouts 78 out of the plurality of cutouts 78. FIG. 15 (A) shows the bearing 81 viewed in a direction B in FIG. 14 (B), and FIG. 15 (B) shows the bearing 82 viewed in a direction C in FIG. 14 (B). The bearings 81 and 82 are respectively formed by bending the body of the guide member 73 in the vicinity of the corresponding selected outputs 78. The bearing 81 has an opening 83 for supporting the shaft 71, and the bearing 82 has an opening 84 for supporting the shaft 71. The opening 83 is used to support the shaft 71 in a manner such that the shaft 71 may recede, and the opening 83 also holds the shaft 71 in the circumferential direction and the axial direction.

Figure 16:
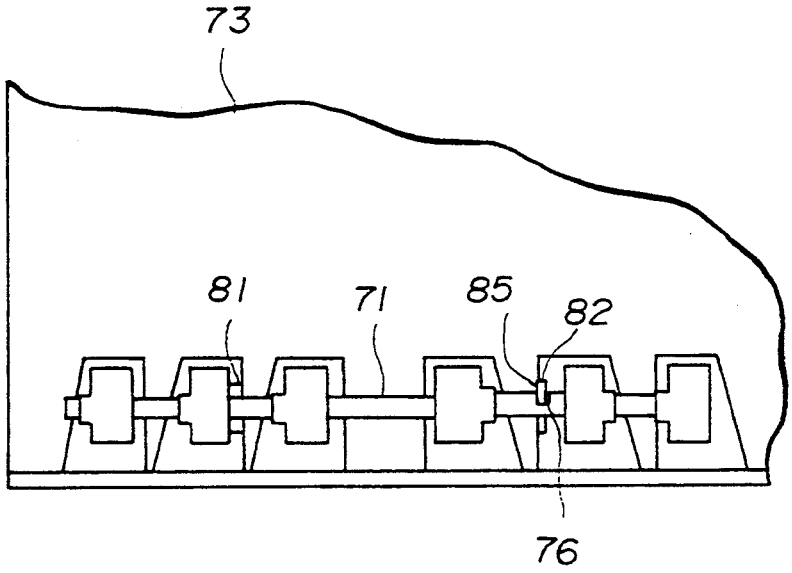
FIG. 16 is a plan view showing the mounting of the shaft with respect to the guide member of the embodiment shown in FIG. 10.

As shown in FIG. 16, the shaft 71 which has the plurality of sub rollers 42 provided thereon is mounted on the guide member 73 in a state where the outer periphery of each sub roller 82 partially fits into a corresponding cutout 78. In this state, the shaft 71 is supported by the bearings 81 and 82, and is also held in the circumferential and axial directions of the shaft 71 by the engagement with an engaging part 85 of the bearing 82 shown in FIG. 15 (B) and with the second groove 76.

Figure 17A:
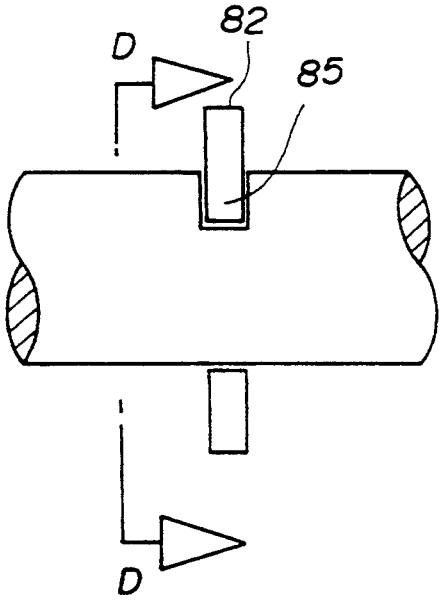
FIG. 17, comprising subparts (A) and (B), is a diagram for illustrating the shaft support by the bearing.
Figure 17B:
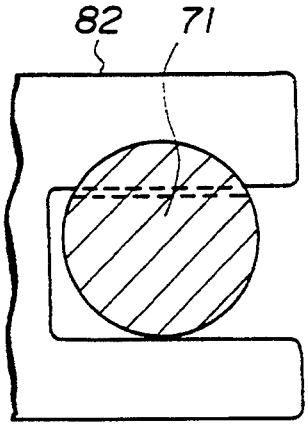
Figure 18:
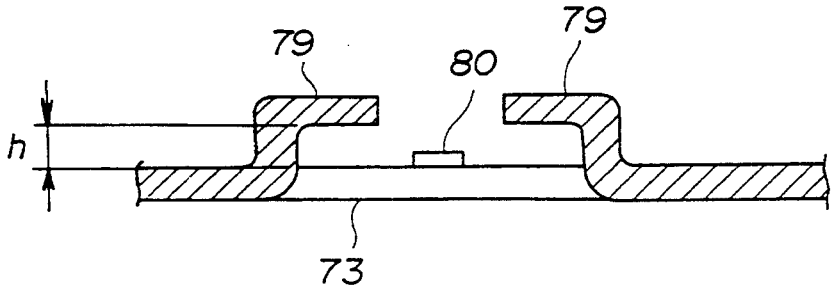
FIG. 18 is a cross sectional view taken along line E—E in FIG. 14 (B)

FIG. 17 is a diagram for explaining the held state of the shaft 71 by the bearing 82. In FIG. 17, (A) shows a plan view of the shaft 71, and (B) shows a cross sectional view taken along a line D—D in (A). FIG. 18 shows a cross section of the holding parts 79 taken along a line E—E in FIG. 14 (B). As shown in FIG. 18, the holding parts 79 have a height h such that the urging means 74 can fit without play.

The urging means 74 in this embodiment is a leaf spring having a positioning hole 86 for engaging the pin 80. As shown in FIG. 10, the urging means 74 is mounted on the guide member 73, and a tip end 87 of the urging means 74 pushes against the shaft 71 which is mounted on the guide member 73.

Figure 19A:
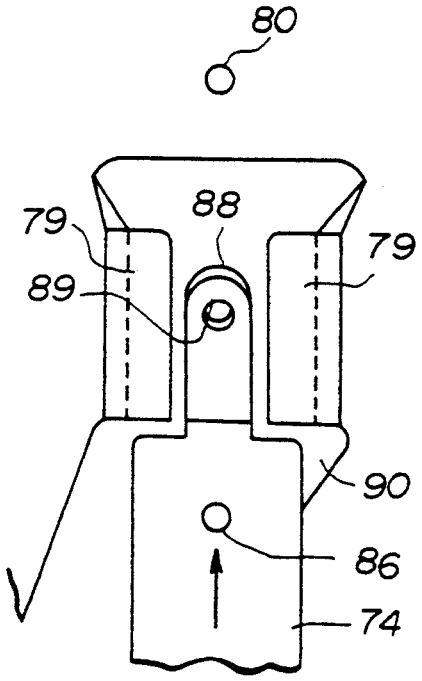
FIG. 19, comprising subparts (A) and (B), is a diagram for illustrating the process of mounting urging means of the embodiment shown in FIG. 10.
Figure 19B:
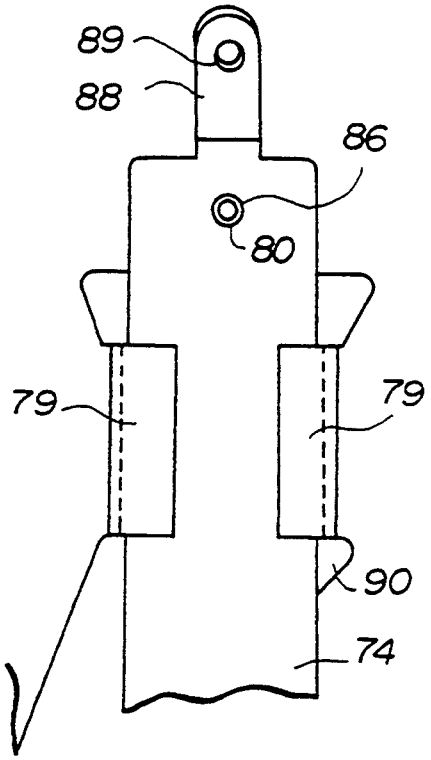

FIG. 19 shows the mounting procedure of the urging means 74. First, the urging means 74 is placed in a vicinity of the engaging parts 79 and moved in the direction of an arrow as shown in FIG. 19 (A). Hence, the urging means 74 fits into the engaging parts 79 as shown in FIG. 19(B), and the positioning hole 86 is engaged by the pin 80. As a result, the urging means 74 is positioned and held in a detachable manner, thereby completing the assembling process.

A manipulating part 88 which is inclined by approximately 22° is formed at the end part of the urging means 74. The above described mounting operation is facilitated by manipulating this manipulating part 88.

Furthermore, a hole 89 may be provided in the manipulating part 88. In this case, a wire (not shown) is inserted through the hole 89, and the mounting operation is further facilitated by manipulating the wire. In addition, a cutout 90 may be formed in the guide member 73 in the periphery of the holding part 79 as shown in FIGS. 10 and 19. In this case, the urging means 74 can be mounted and detached with more ease.

Therefore, according to this sub roller support structure, it is possible to facilitate the operation of mounting the shaft on the guide member and mounting on the guide member the urging means for urging the shaft. The number of assembling steps required, the number of parts required, and the production cost can all be reduced. In addition, each sub roller is urged by the urging means via the shaft, and makes satisfactory pressing contact with the corresponding transport roller on the driving side, thereby enabling satisfactory paper transport.

This embodiment of the sub roller support structure can be applied to each of the rollers of the paper transport mechanism described above.

Of course, the sub roller support structure itself is not limited to the application to the image forming apparatuses such as the printer. For example, it is possible to apply the sub roller support structure to an automatic teller machine or the like.

Further, the present invention is not limited to these embodiments, but various variations and modifications may be made without departing from the scope of the present invention.

What is claimed is:

1. A paper transport mechanism comprising:

a first guide plate rotatable about a first axis parallel to the paper transport direction having an end part, a rotation fulcrum located in a vicinity of the end part, and first rollers, said first guide plate having an open position and a closed position and being normally closed;

a second guide plate having a first surface part which confronts the first guide plate with a gap formed therebetween in the closed position of the first guide plate, a second surface part which is curved, second rollers, and fourth rollers which make pressing contact with the first rollers in the closed position of the first guide plate so as to transport a paper between the first and second guide plates;

a third guide plate rotatable about a second axis transverse to the transport direction having a third surface part which confronts the second surface part of the second guide plate with a gap formed therebetween, and third rollers which make pressing contact with the second rollers in the closed position of the first guide plate so as to transport a paper between the second and third guide plates; and rotating means, coupled to the first and third guide plates, for rotating the third guide plate about the second axis, and thereby urging the third rollers against the second rollers in the closed position of the first guide plate and for separating the third rollers from the second rollers in the open position of the first guide plate.

2. A paper transport mechanism comprising:

a first guide plate having an end part, a rotation fulcrum located in a vicinity of the end part, and first rollers, said first guide plate having an open position and a closed position and being normally closed;

a second guide plate having a first surface part which confronts the first guide plate with a gap formed therebetween in the closed position of the first guide plate, a second surface part which is curved, second rollers, and fourth rollers which make pressing contact with the first rollers in the closed position of the first guide plate so as to transport a paper between the first and second guide plates;

a third guide plate having a third surface part which confronts the second surface part of the second guide plate with a gap formed therebetween, and third rollers which make pressing contact with the second rollers in the closed position of the first guide plate so as to transport a paper between the second and third guide plates;

urging means, coupled to the first and third guide plates, for urging the third rollers against the second rollers in the closed position of the first guide plate and for separating the third rollers from the second rollers in the open position of the first guide plate;

a rotatable shaft having a first part for supporting the third guide plate and a second part; and spring means, coupled to the second part of the rotatable shaft, for urging the rotatable shaft to rotate in a direction so that the third rollers engage the second rollers, said spring means further comprising a part which is engaged by the first guide plate in the closed position, so that the rotatable shaft is prevented from rotating in the closed position of the first guide plate.

3. The paper transport mechanism as claimed in claim 2, wherein said spring means comprises:

a lever having a central part fixed to the second part of the rotatable shaft, a first end and a second end; and a spring which connects to the first end of the lever so as to urge the rotatable shaft to rotate in a direction so that the third rollers engage the second rollers, said second end of the lever being engaged by the first guide plate in the closed position, so that the rotatable shaft is prevented from rotating in the closed position of the first guide plate.

4. The paper transport mechanism as claimed in claim 2, wherein at least one roller, out of the first through fourth rollers, is supported by a roller support structure comprising:

a shaft having a peripheral surface, and at least one first groove and at least one second groove which are provided in the peripheral surface, said first groove having a ring shape, said second groove having a semi-circular shape;

a pair of bearings for supporting the shaft including an engaging part for engaging the second groove so as to restrict the shaft in the circumferential and axial directions thereof; and spring means, provided on a corresponding one of the first, second and third guide plates, for urging the shaft in a direction so that said one roller makes pressing contact with a corresponding one of the first, second and third rollers, said one roller having resilient engaging parts for engaging the first groove of the shaft.

5. The paper transport mechanism as claimed in claim 4, wherein said corresponding one of the first, second and third guide plates comprise:

a holding part for detachably holding said spring means; and a positioning part for positioning said spring means.

6. The paper transport mechanism as claimed in claim 4, wherein said pair of bearings comprise holes for supporting the shaft in a manner movable in directions toward and away from the corresponding roller to which said one roller makes pressing contact.

7. The paper transport mechanism as claimed in claim 4, wherein said spring means comprises a leaf spring.

8. The paper transport mechanism as claimed in claim 7, wherein the leaf spring has a manipulating part provided on a tip end thereof.

9. The paper transport mechanism as claimed in claim 8, wherein a hole is provided in the manipulating part.

10. A paper transport mechanism comprising:

a first guide plate having an end part, a rotation fulcrum located in a vicinity of the end part, and first rollers, said first guide plate having an open position and a closed position and being normally closed;

a second guide plate having a first surface part which confronts the first guide plate with a gap formed therebetween in the closed position of the first guide plate, a second surface part which is curved, second rollers, and fourth rollers which make pressing contact with the first rollers in the closed position of the first guide plate so as to transport a paper between the first and second guide plates;

a third guide plate having a third surface part which confronts the second surface part of the second guide plate with a gap formed therebetween, and third rollers which make pressing contact with the second rollers in the closed position of the first guide plate so as to transport a paper between the second and third guide plates;

urging means, coupled to the first and third guide plates, for urging the third rollers against the second rollers in the closed position of the first guide plate and for separating the third rollers from the second rollers in the open position of the first guide plate wherein a plurality of second and third guide plates are provided with respect to the first guide plate.

11. The paper transport mechanism as claimed in claim 10, wherein at least one roller, out of the first through fourth rollers, is supported by a roller support structure comprising:

a shaft having a peripheral surface, and at least one first groove and at least one second groove which are provided in the peripheral surface, said first groove having a ring shape, said second groove having a semi-circular shape;

a pair of bearings for supporting the shaft including an engaging part for engaging the second groove so as to restrict the shaft in the circumferential and axial directions thereof; and spring means, provided on a corresponding one of the first, second and third guide plates, for urging the shaft in a direction so that said one roller makes pressing contact with a corresponding one of the first, second and third rollers, said one roller having resilient engaging parts for engaging the first groove of the shaft.

12. The paper transport mechanism as claimed in claim 11, wherein said corresponding one of the first, second and third guide plates comprise:

a holding part for detachably holding said spring means; and a positioning part for positioning said spring means.

13. The paper transport mechanism as claimed in claim 11, wherein said pair of bearings comprise holes for supporting the shaft in a manner movable in directions toward and away from the corresponding roller to which said one roller make pressing contact.

14. The paper transport mechanism as claimed in claim 11, wherein said spring means comprises a leaf spring.

15. The paper transport mechanism as claimed in claim 14, wherein the leaf spring has a manipulating part provided on a tip end thereof.

16. The paper transport mechanism as claimed in claim 15, wherein a hole is provided in the manipulating part.

* * * * *

UNITED STATES PATENT AND TRADEMARK OFFICE

CERTIFICATE OF CORRECTION

PATENT NO. : 5,368,290

DATED : November 29, 1994

INVENTOR(S) : Hideyuki NANBA et al.

It is certified that error appears in the above-indentified patent and that said Letters Patent is hereby corrected as shown below:

In the Drawings:

Fig. 14 (A) should be labelled "Fig. 14 (B)".
Fig. 14 (B) should be labelled "Fig. 14 (A)".

Col. 3, line 14, delete "for";
line 17, delete "for";
line 18, delete "for";
line 28, delete "for";
line 31, change "for explaining" to --illustrating--;
line 34, delete "for";
line 37, delete "for";
line 43, delete "for"; and
line 47, delete "for".

UNITED STATES PATENT AND TRADEMARK OFFICE

CERTIFICATE OF CORRECTION

PATENT NO. : 5,368,290

DATED : November 29, 1994

INVENTOR(S) : Hideyuki NANBA et al.

It is certified that error appears in the above-indentified patent and that said Letters Patent is hereby corrected as shown below:

Col. 7, line 26, change "sown", to --shown--.

Col. 8, line 45, "Fig. 18" should begin a new paragraph.

Col. 9, line 4, "In" should begin a new paragraph.

Signed and Sealed this

Eleventh Day of April, 1995

Bruce Lehman

*Attest:*

BRUCE LEHMAN

*Attesting Officer*

*Commissioner of Patents and Trademarks*